United States Patent [19]

Hidle

[11] Patent Number: 4,600,162

[45] **Date of Patent: * Jul. 15, 1986**

[54] PAPER TOWEL INSERT AND DISPENSER

[75] Inventor: Jerry Hidle, Panama City, Fla.

[73] Assignee: Panhandle Industries, Inc., Panama City, Fla.

[ * ] Notice: The portion of the term of this patent subsequent to Aug. 20, 2002 has been disclaimed.

[21] Appl. No.: 712,224

[22] Filed: Mar. 15, 1985

Related U.S. Application Data

[63] Continuation-in-part of Ser. No. 596,352, Apr. 3, 1984, Pat. No. 4,535,947.

[51] Int. Cl.[4] ..... B65H 16/06; B65H 19/10

[52] U.S. Cl. ..... 242/55.2; 242/68.4; 242/129.51

[58] Field of Search ..... 242/55.2, 55.3, 55.53, 242/68, 68.4, 129.51, 18 DD, 129.53, 68.3

[56] References Cited

U.S. PATENT DOCUMENTS 4,535,947 8/1985 Hidle ..... 242/55.2

*Primary Examiner*—Stanley N. Gilreath

*Attorney, Agent, or Firm*—Watson, Cole, Grindle & Watson

[57] ABSTRACT

A dispenser for rolled material has a pair of opposed support arms each provided with a cylindrical support for insertion within a tube about which the rolled material is scrolled. A tubular support assembly is provided for insertion within one or both cylindrical supports for increasing the degree of axial support for more positively supporting and securing the roll on the dispenser. The support plug has limit stops on opposite ends for limiting plug movement in its inwardly and outwardly extended positions, and the plug is capable of being positively retained in its inwardly extended position.

12 Claims, 9 Drawing Figures

PAPER TOWEL INSERT AND DISPENSER

RELATED APPLICATION

This application is a continuation-in-part of U.S. application Ser. No. 596,352, filed Apr. 3, 1984 now U.S. Pat. No. 4,535,947.

BACKGROUND OF THE INVENTION

This invention relates generally to a dispensing apparatus for rolled material, and more particularly to a paper towel dispenser and an insert assembly for securing a roll of paper towels to a paper towel holder so as to prevent unintended removal of the paper roll from the holder.

A common problem encountered with the dispensing of rolled articles is the unintended disconnection or removal of scrolled material such as a roll of paper towels, wax paper, or any other similar material from its support. For example, a roll of paper towels is normally supported between a pair of opposing support arms. The support arms are each typically provided with a cylindrical support in the form of a sleeve which is axially inserted within a hollow tubular core member about which the paper towels are scrolled. The cylindrical supports are usually biased inwardly toward the center of the rolled article by the inherent elastic properties of the support arm material. Accordingly, the support arms must be deformed outwardly and spread apart to permit the cylindrical supports to be inserted within the opposite ends of the core of the paper towel scroll.

Once the core has been mounted on a dispenser in the aforedescribed manner, it frequently occurs that the roll becomes dismounted intentionally during use. For example, while a supply of materials being unrolled from the dispenser, the force applied to the cylindrical supports will cause the support arms to deflect outwardly thereby permitting one or both ends of the roll of material to become disconnected from the support arms. Such an occurrence often results in a loss of the scrolled material and, of course, inconveniences the user by having to remount the roll on its support.

While many paper towel holders have been designed, none offers the simplicity and economy of the present invention while at the same time preventing unintended removal of the paper roll from the roll holder. For example, U.S. Pat. No. 2,917,249 to MacLelland discloses a paper roll support having plugs extending into opposing ends of a paper roll for solely supporting the roll thereon. For reloading, either plug must be turned to withdraw it completely outwardly of the roll.

Thus, there exists the need for a simple and economical device for securing and locking a roll of material such as paper towels between a pair of opposed support arms.

SUMMARY OF THE INVENTION

It is therefore an object of the present invention to overcome the problems and meet the needs described above by the provision of a device which permits a roll of material to be supported on a roll dispenser in a manner to avoid unintended removal of the roll during dispensing while at the same time permitting reloading of the roll in a simple yet highly effective manner.

The paper roll dispenser according to the invention is structured to prevent a paper roll from sliding off its support arms. A support plug is coaxially disposed within a support cylinder of a paper towel holder such as those currently commercially available. The support plug is inserted within either or both cylindrical support cylinders which are normally provided along the end portions of a pair of support arms. The support plug is adapted for axial displacement within the support cylinder and has a length substantially greater than the length of the cylinder into which it is inserted. Thus, in addition to the support cylinders, the plug or plugs project into the paper roll for further supporting the roll and for preventing unintended removal of the paper roll from the dispenser. Ribs or flanges on the plug, spaced apart a distance greater than the length of the support cylinder, limit movement of the plug in inwardly and outwardly extended positions thereof as these ribs function as limit stops in contact engagement with the support cylinder in such extended positions.

The outer rib on the plug may be designed to frictionally engage the support cylinder for retaining the plug in its inwardly projected position.

Otherwise, the plug may have a retention feature in the form of a detent or a lock bar, located between the spaced ribs, which engages a recess provided in the support cylinder for retaining the plug in its inwardly projected position.

Other objects, advantages and novel features of the invention will become more apparent from the following detailed description of the invention when taken in conjunction with the accompanying drawings.

DETAILED DESCRIPTION OF THE INVENTION

Figure 1:
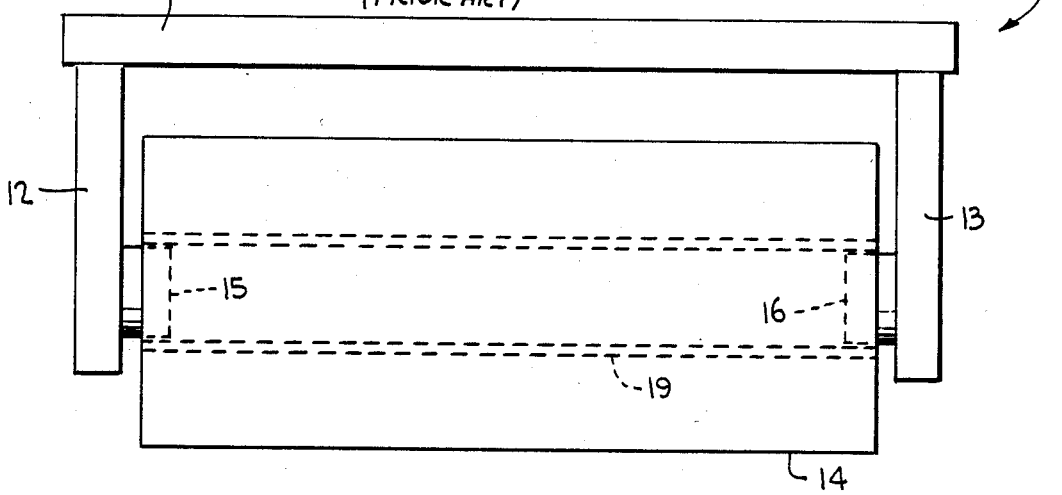
FIG. 1 (PRIOR ART)
FIG. 1 is a front elevational view of a typical prior part paper roll dispenser.

Turning now to the drawings wherein like reference characters refer to like and corresponding parts throughout the several views, a paper roll dispenser of known construction, generally designated 10 in FIG. 1, has a central body section 11 capable of being secured to a wall or similar support surface in any normal manner. A pair of support arms 12, 13 extend from body section 11 and are typically biased inwardly toward a paper roll 14 shown mounted on the dispenser. Each support arm has an inwardly projecting support cylinder 15, 16 each in the form of a short sleeve usually made integral with the associated wall 17, 18 of the support arms (see FIG. 2).

The paper roll has a tube 19 forming a core about which a roll of paper material of the paper roll is scrolled. The paper roll tube is typically mounted within dispenser 10 by fitting one end of tube 7 over one of the support cylinders 15, 16 and applying an axial force generally along the direction of the paper roll axis so as to deflect the other arm 12, 13 outwardly to allow the opposing end of tube 19 to be fitted over the opposing support cylinder.

Once a paper roll has been mounted in such manner, it is not uncommon for the roll to be unintentionally dismounted or disconnected from dispenser 10. This typically occurs when a user exerts a relatively large force on the paper roll when carrying a quantity of paper therefrom. A component of force is directed along the central axis of the paper roll so as to deflect one or both support arms outwardly thereby resulting in the paper roll tube 19 becoming disconnected from support cylinders 15, 16 such that the paper roll becomes unintentionally separated from the dispenser.

To prevent such unintentional removal of the paper roll from the dispenser, the axial penetration of support cylinders 15, 16 within tube 19 could be increased. However, by increasing such penetration the outward deflection of support arms 12, 13 must be accordingly increased when reloading a paper roll on the dispenser. Since a typical roll dispenser 10 is simply and economically constructed of plastic material, the outward deflection of support arms 12, 13 is effectively limited upon reaching the elastic limit of the material. The same consideration applies for a paper roll dispenser constructed of metal. It has been found that the elastic limit of such plastic or metallic material is reached before an adequate clearance can be provided between opposing support arms 12, 13 to permit paper roll 14 of standard commercially available dimensions to be mounted upon support cylinders 15, 16 having an axial penetration within paper roll tube 19 sufficiently deep to prevent any unintentional removal of the paper roll from the dispenser.

Figure 2:
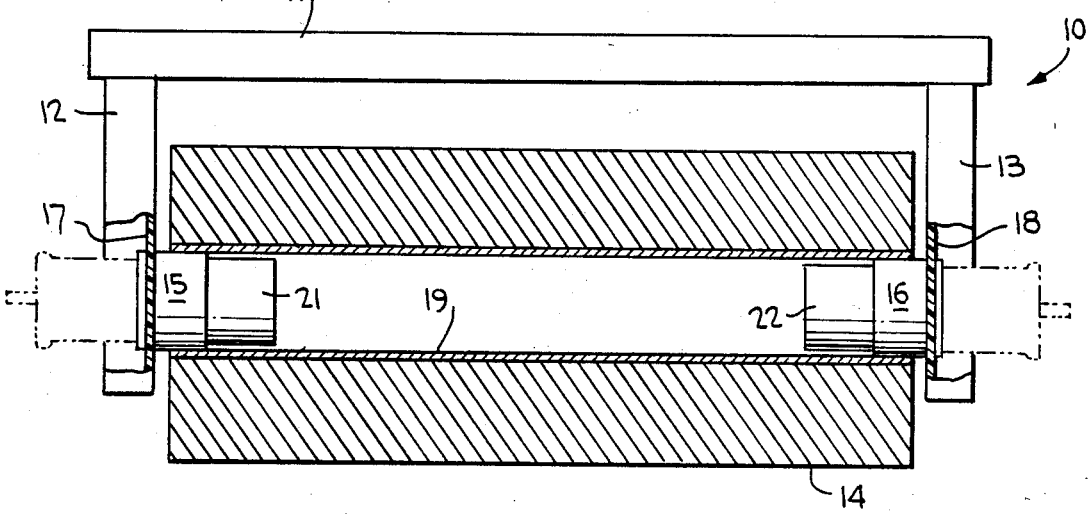
FIG. 2 is a front elevational view, partly in section, of the FIG. 1 paper roll dispenser incorporating the support plugs according to the invention.

Due to the elastic limits and design considerations noted above, a support plug 21 and/or 22, as shown in FIG. 2, is provided in accordance with the invention to prevent the unintended removal of paper roll 14 from dispenser 10 without requiring undue deflection of support arms 12, 13 beyond their elastic limits. Either a single support plug or a pair of such plugs may be provided with each paper roll dispenser.

Figure 3:
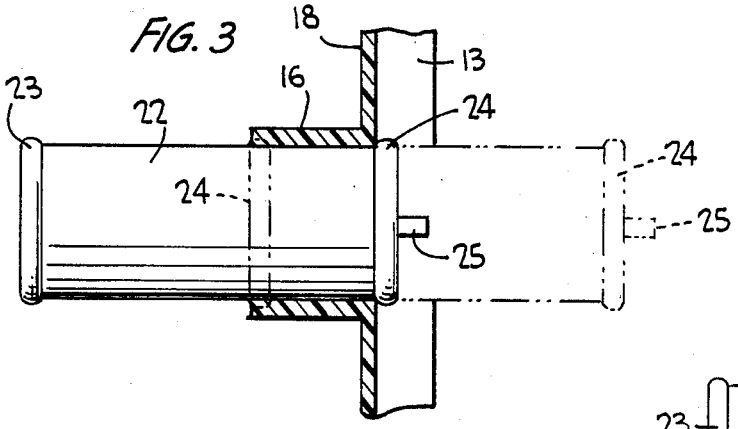
FIG. 3 is a partial and slightly enlarged view, similar to that of FIG. 2, of the details of a support plug shown in its inwardly projected position during use.
Figure 4:
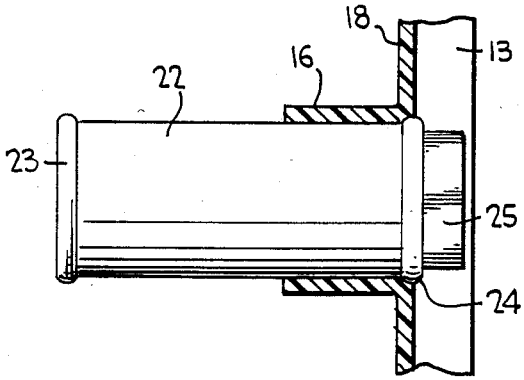
FIG. 4 is a view similar to FIG. 3 showing the support plug positively retained in its inwardly projected position.

One of the support plugs 22 is shown in greater detail in FIGS. 3 and 4 according to one embodiment of the invention. Plug 22 may be in the form of a solid cylinder of plastic material such as polypropylene having a greater stiffness and hardness in comparison with the plastic material from which dispenser 10 is formed, such as high-density polyethylene. The plug has a length substantially greater than the length of support cylinder 16 through which it extends for axial movement between its fully inwardly projected position shown in solid outline in FIG. 3, and its fully outwardly projected position shown in phantom outline in FIG. 3. The plug has a thickened external portion at its inner end which may be in the form of a thin annular rib 23 for limiting axial movement of the plug in its outwardly extended position as rib 23 frictionally engages support cylinder 16 as shown in phantom outline in FIG. 3. And, the plug has a thickened external portion at its outer end which may be in the form of a thin rib 24 for limiting movement of the plug in the inwardly extended position thereof, as shown in FIG. 3. And, with rib 24 being of a harder material compared with support cylinder 16, the plug may be pushed further inwardly to its FIG. 4 position such that the rib 24 frictionally engages support cylinder 16 for retaining the plug in its inwardly projected position. Moreover, the plug may be retained in its outwardly projected position, during reloading, as rib 24 frictionally engages cylinder 16 as shown in phantom outline in FIG. 3.

A grasp bar 25 may be molded onto the outer end wall of the plug to facilitate axial movement of the plug by the user.

Plug 21 may be similarly constructed in a manner described with reference to FIGS. 3 and 4. And, thickened portions may be provided other than in the form of ribs 23 and 24, such as for example discontinuous detents or the like, without departing from the invention.

Figure 5:
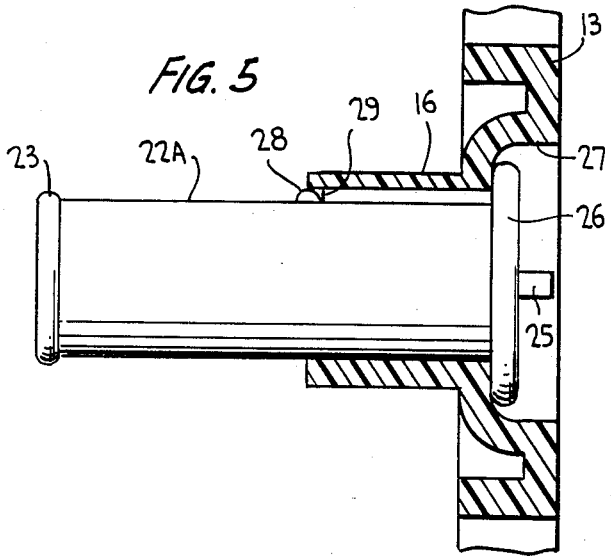
FIG. 5 is a view similar to FIG. 3 of another embodiment of the invention.
Figure 6:
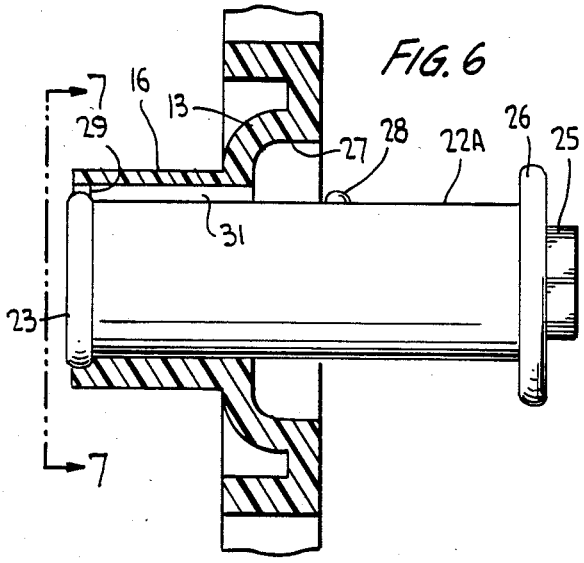
FIG. 6 is a view similar to FIG. 5 showing the plug in its outwardly extended position.
Figure 7:
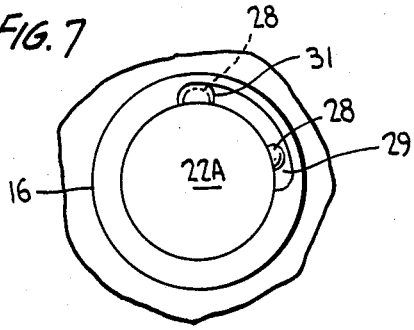
FIG. 7 is an end view taken substantially along the line 7—7 of FIG. 6.

A support plug 22A is shown in FIGS. 5 to 7 in accordance with another embodiment of the invention. The plug has a rib 23 or the like for limiting plug movement in its outwardly extended position of FIG. 6 similarly as described with reference to FIG. 3. However, the plug has a thickened flange or rib 26, of greater diameter compared to rib 24, at its outer end for limiting the plug in its inwardly extended position of FIG. 5 as flange 26 seats within a recess 27 formed in support arm 13. And, for retaining plug 22A in its inwardly extended position of FIG. 5, a detent in the form of a bead 28 or the like is externally molded on the plug betweem rob 23 and flange 26 for engaging a recess in the form of a transverse groove 29 provided in the inner wall of support cylinder 16 at the inner end thereof, as more clearly shown in FIG. 7.

The inner surface of cylinder 16 is likewise provided with an axial groove 31 which terminates in groove 29 to permit axial movement of plug 22A from its outwardly extending position of FIG. 6 to its inwardly extended position of FIG. 5 as bead 28 slides along groove 31. Thus, during operation, the user simply aligns bead 28 with groove 31, as in FIG. 6, moves the plug to its FIG. 5 position, and thereafter rotates the plug about its central axis so as to move bead 28 into transverse groove 29, as shown in FIG. 7. The plug is thus securely retained in place during towel dispensing.

Figure 8:
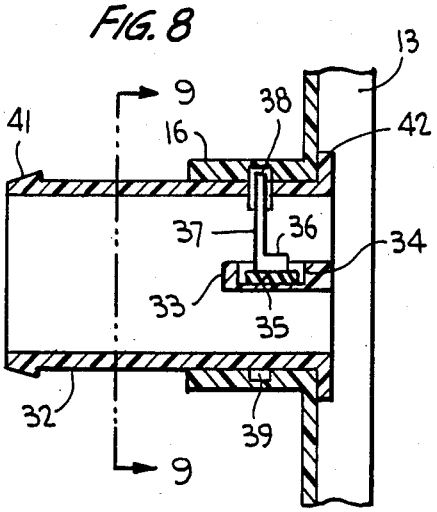
FIG. 8 is a view similar to FIG. 5 of yet another embodiment according to the invention.
Figure 9:
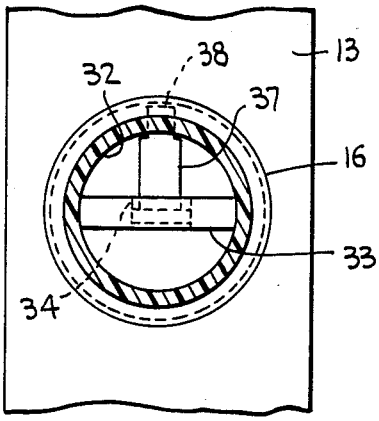
FIG. 9 is a view taken substantially along the line 9—9 of FIG. 8.

A further embodiment of the invention is shown in FIGS. 8 and 9 which is essentially the same as one of the embodiments disclosed in parent application Ser. No. 596,352. Here, a support plug in the form of a hollow tube 32 is shown in its inwardly extended and locked position of FIG. 8. A tranversely extending grasp bar 33 is secured to the tube in any normal manner, and a recess 34 is provided in the grasp bar for the reception of an elastic spring element 35. Such element may be in the form of a solid rubber material or foam rubber material secured to the grasp bar within its recess. A base portion 36 of a lock bar 37 is similarly secured to the upper surface of elastic element 35 and is dimensioned to be slidingly received within recess 34. In such manner, the base portion of the lock bar may be depressed within recess 34 by a manual pinching action such that the lock bar is displaced radially inwardly within support tube 32. This inward radial movement of the locking bar causes a locking projection 38 of the lock bar to move beneath the outer surface of support tube 32. It will be seen that such movement will permit the support tube to be axially moved within support cylinder 16 to its inwardly extended position of FIG. 5 and, upon release of the lock bar, be positively retained in place.

Also, support cylinder 16 has an annular groove 39 for receiving locking projection 38, although groove 31 may be omitted since locking projection 38 may be coated with a material having a high coefficient of friction, such as a rubber material, to effect a frictional contact with the inner surface of support cylinder 16.

The inner end of support tube 32 may be provided with a radially outwardly extending shoulder portion 41 having an outer diameter slightly greater than the inner diameter of support cylinder 16. This construction will permit support tube 32 to be inserted within cylinder 16 yet prevent the support tube from being withdrawn therefrom once inserted. And, an outer flange 42 may be provided on the outer end surface of plug 32 to both limit the inward extent of the support plug and to align the lock bar with groove 39 in the event support cylinder 16 is provided with such groove. Thus, with support plug 32 having both a shoulder 41 and flange 42, it will once inserted be permanently secured within cylinder 16 so as to prevent its subsequent misplacement or loss.

In lieu of a spring cushion 35, alternative locking bar biasing means may be provided in the form of coil or leaf springs, or the like, without departing from the invention. And, support plugs 22 and 22A may likewise be in the form of a hollow sleeve, rather than of solid material, within the scope of the invention.

Obviously, many other modifications and variations of the present invention are made possible in the light of the above teachings. It is therefore to be understood that within the scope of the appended claims the invention may be practiced otherwise than as specifically described.

What is claimed is:

1. A paper roll dispenser, comprising:

a central body portion;

first and second support arms respectively extending from opposite end portions of said central body portion for supporting a paper roll therebetween;

first and second support cylinders provided on respective end portions of said support arms for insertion within the paper roll for supporting the roll thereon, said support cylinders each having a predetermined length and extending inwardly toward each other from inner surfaces of said end portions;

a cylindrical support plug axially received within at least one said support cylinder for axial movement relative thereto and having a length substantially greater than said predetermined length of said one support cylinder, grasp means on said support plug for axially moving said plug within said one support cylinder between an inwardly projected position and an outwardly extended position, a first annular rib on said support plug extending radially outwardly from the outer surface thereof capable of bearing engagement with said one support cylinder for limiting movement of said plug in said outwardly extended position thereof, and a second annular rib on said support plug extending radially outwardly from said outer surface thereof capable of bearing engagement with said one suppoort cylinder for limiting movement of said plug in said inwardly projected position thereof, said ribs being spaced apart a distance greater than said predetermined length of said one support cylinder, whereby said support plug in said inwardly projected position thereof extends a greater distance within the paper roll compared to that of said one support cylinder for further supporting the roll and for preventing unintended removal of the paper roll from the dispenser.

2. The dispenser according to claim 1, wherein said second rib frictionally engages said one support cylinder for retaining said support plug in said inwardly projecting position.

3. The dispenser according to claim 1, wherein said one support cylinder has a recess therein, and means on said support plug extending radially outwardly from said outer surface thereof and engageable with said recess for retaining said support plug in said inwardly projecting position.

4. The dispenser according to claim 3, wherein said means comprises a detent located between said ribs.

5. The dispenser according to claim 3, wherein said means comprises a detent located between said first and second ribs, said support cylinder further having an axial groove terminating in said recess to permit axial movement of said support plug into said inwardly projecting position.

6. The dispenser according to claim 3, wherein said means comprise a lock bar and resilient means biasing said bar into locking engagement with said recess.

7. The dispenser according to claim 6, wherein said lock bar is located between said ribs.

8. A paper roll dispenser, comprising:

a central body portion;

first and second support arms respectively extending from opposite end portions of said central body portion for supporting a paper roll therebetween;

first and second support cylinders provided on respective end portions of said support arms for insertion within the paper roll for supporting the roll thereon, said support cylinders each having a predetermined length and extending inwardly toward each other from inner surfaces of said end portions;

a cylindrical support plug axially received within at least one said support cylinder for axial movement relative thereto and having a length substantially greater than said predetermined length of said one support cylinder, said one support cylinder having a recess therein, grasp means on said support plug for axially moving said plug within said one support cylinder between an inwardly projected position and an outwardly extended position, first means on said support plug extending radially outwardly from the outer surface thereof capable of bearing engagement with said one support cylinder for limiting movement of said plug in said outwardly extended position thereof, second means on said support plug extending radially outwardly from said outer surface thereof capable of bearing engagement with said one support cylinder for limiting movement of said plug in said inwardly projected position thereof, and third means on said support plug extending radially outwardly from said outer surface thereof and engageable with said recess for retaining said support plug in said inwardly projected position, said third means comprising a detent located between said first and second means, said support cylinder further having an axial groove terminating in said recess to permit axial movement of said support plug into said inwardly projected position, said first and second means being spaced apart a distance greater than said predetermined length of said one support cylinder, whereby said support plug in said inwardly projected position thereof extends a greater distance within the paper roll compared to that of said one support cylinder for further supporting the roll and for preventing unintended removal of the paper roll from the dispenser.

9. The dispenser according to claim 8, wherein said first and second means on said support plug respectively comprise first and second annular ribs on said support plug.

10. the dispenser according to claim 9, wherein said second rib frictionally engages said one support cylinder for retaining said support plug in said inwardly projecting position.

11. The dispenesr according to claim 8, wherein said third means comprise a lock bar and resilient means biasing said bar into locking engagement with said recess.

12. The dispenser according to claim 11, wherein said first and second means respectively comprise first and second annular ribs on said support plug, said lock bar being located between said ribs.

* * * * *